United States Patent [19]

Cullen et al.

[11] 4,405,347

[45] Sep. 20, 1983

[54] ADSORBENT UNIT FOR MOUNTING IN THE UPPER PORTION OF A REFRIGERANT RECEIVER

[75] Inventors: John S. Cullen, Buffalo; Samuel A. Incorvia; James A. Vogt, both of Tonawanda, all of N.Y.

[73] Assignee: Multiform Desiccants, Inc., Buffalo, N.Y.

[21] Appl. No.: 338,227

[22] Filed: Jan. 11, 1982

[51] Int. Cl.[3] ..... B01D 53/04

[52] U.S. Cl. ..... 55/387; 55/515; 62/503; 210/282

[58] Field of Search ..... 55/179, 316, 387, 389, 55/515, 518; 62/503; 210/282, DIG. 6

[56] References Cited

U.S. PATENT DOCUMENTS

| | | | |
|---|---|---|---|
| 3,734,296 | 5/1973 | Proctor et al. | 210/DIG. 6 |
| 3,755,994 | 9/1973 | Bidiwala | 55/387 |
| 3,798,921 | 3/1974 | Scherer et al. | 55/387 X |
| 3,938,351 | 2/1976 | Schumacher | 55/387 X |
| 3,990,872 | 11/1976 | Cullen | 55/515 X |
| 4,072,615 | 2/1978 | McConnell | 55/387 X |
| 4,111,005 | 9/1978 | Livesay | 62/503 |
| 4,116,649 | 9/1978 | Cullen et al. | 55/387 |
| 4,177,048 | 12/1979 | Rivers et al. | 55/387 X |
| 4,187,695 | 2/1980 | Schumacher | 55/387 X |
| 4,199,960 | 4/1980 | Adams et al. | 62/503 |
| 4,270,934 | 6/1981 | Widdowson et al. | 55/316 |
| 4,276,756 | 7/1981 | Livesay | 62/503 |
| 4,291,548 | 9/1981 | Livesay | 62/503 |
| 4,331,001 | 5/1982 | Jones | 62/503 |

*Primary Examiner*—Robert H. Spitzer
*Attorney, Agent, or Firm*—Joseph P. Gastel

[57] ABSTRACT

An adsorbent unit for mounting on a refrigerant conduit in the top portion of a refrigerant receiver including first and second adsorbent containers having porous walls connected by a harness which is an extension of the walls of the containers, a tubular member secured to the harness for telescopic mounting onto an open end of the refrigerant conduit, the first container having a full pocket shape and the second container being U-shaped with a pair of legs on opposite sides of an opening therebetween, and the harness extending between the first container and the upper portion of one of the legs.

31 Claims, 14 Drawing Figures

Fig. 9.
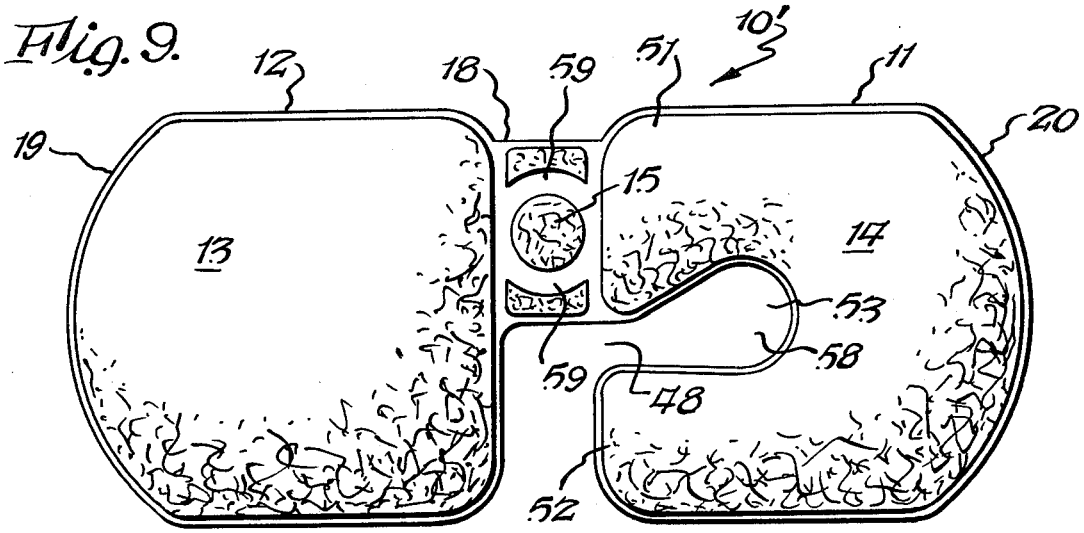
Fig. 10.
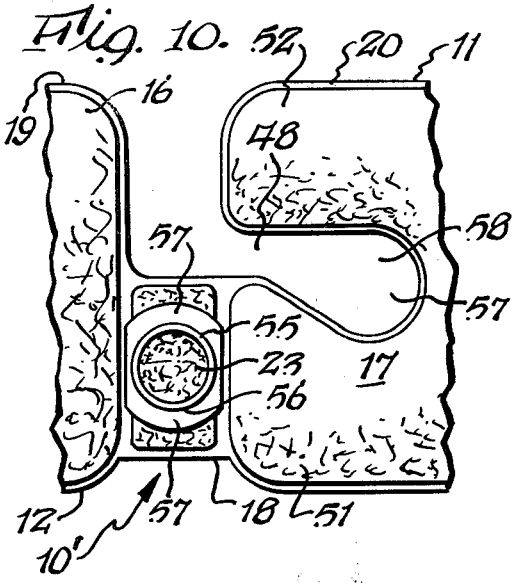
Fig. 11.
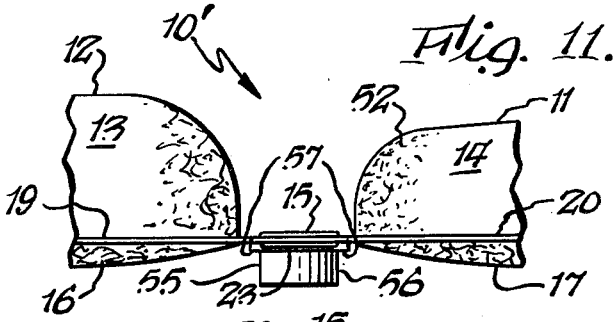
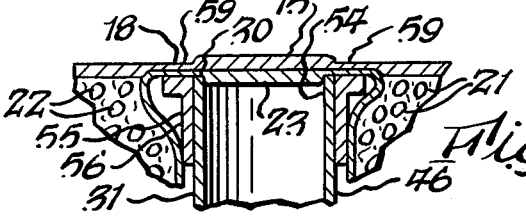
Fig. 14.
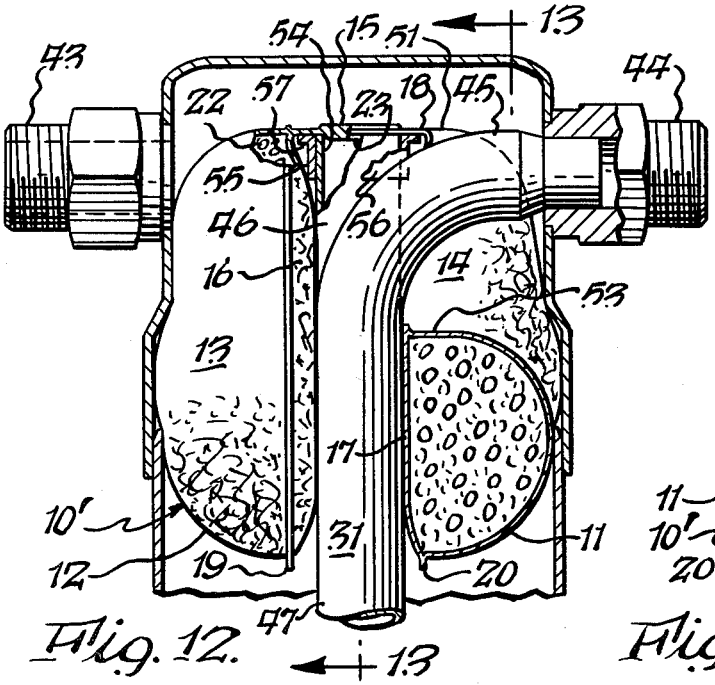
Fig. 12.
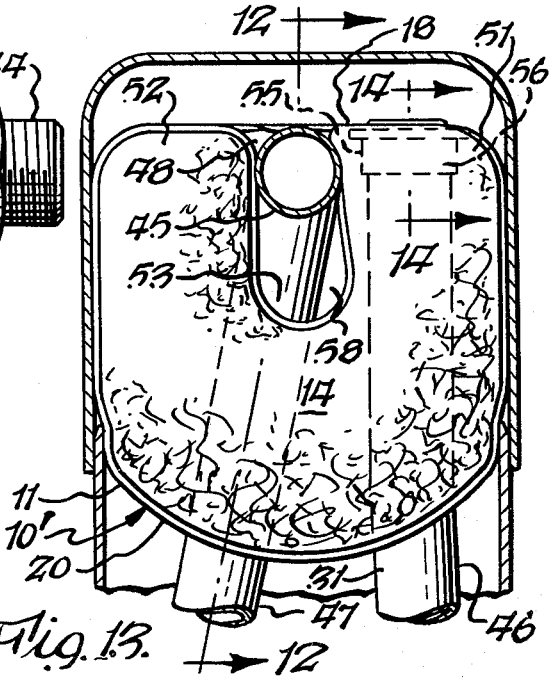
Fig. 13.

ADSORBENT UNIT FOR MOUNTING IN THE UPPER PORTION OF A REFRIGERANT RECEIVER

BACKGROUND OF THE INVENTION

The present invention relates to an improved adsorbent unit which includes a pair of adsorbent containers and a securing harness joining the containers for mounting the unit in position in its operational environment.

By way of background, it is common to place an adsorbent unit in the receiver of a refrigeration system to adsorb undesirable substances from the refrigerant. In the past the unit was fixedly positioned in the lower portion of the receiver wherein it was at least partly immersed in refrigerant liquid. Examples of prior structures for mounting an adsorbent container in a refrigerant receiver are disclosed in U.S. Pat. No. 4,116,649 and in copending application Ser. No. 172,266, filed July 25, 1980. It has been found that better adsorption is obtained when the adsorbent unit is mounted in the top of the refrigerant receiver. This is due to the fact that the adsorbent unit is directly exposed to the liquid refrigerant entering the receiver and thereafter is exposed to the gaseous refrigerant which rises to the top of the receiver. However, in the past there was no practical way of securing the adsorbent unit in position against undesired movement and to cause it to occupy a maximum amount of space so as to provide a relatively large capacity for adsorption of refrigerant.

SUMMARY OF THE INVENTION

It is accordingly one object of the present invention to provide an improved adsorbent unit which has a mounting member formed thereon and which can be fixedly positioned in its operating environment in the top of a refrigerant receiver in an extremely simple and expedient manner.

Another object of the present invention is to provide an improved adsorbent unit which occupies an extremely large portion of the upper portion of a refrigerant receiver, to thereby provide a relatively large adsorbing capacity.

A further object of the present invention is to provide an improved adsorbent unit for a refrigerant receiver which can be fabricated in a relatively simple and expedient manner. Other objects and attendant advantages of the present invention will readily be perceived hereinafter.

The present invention relates to an adsorbent unit comprising a pair of containers having porous walls, adsorbent in said containers, harness means coupling said containers to each other, and mounting means for mounting said adsorbent unit on an upper portion of a refrigerant conduit in a refrigerant receiver. In its more specific aspects, the harness means comprises an extension of the walls of the containers, and a tubular member is secured to the harness for telescopic mounting onto the open end of the refrigerant conduit in the upper portion of the refrigerant receiver.

The various aspects of the present invention will be more fully understood when the following portions of the specification are read in conjunction with the accompanying drawings wherein:

BRIEF DESCRIPTION OF THE DRAWINGS

FIG. 9 is a top plan view of a modified adsorbent unit;

FIG. 10 is a fragmentary bottom plan view of the unit of FIG. 9;

FIG. 11 is a fragmentary side elevational view of the unit of FIG. 9;

FIG. 12 is a fragmentary cross sectional view taken substantially along line 12—12 of FIG. 13 and showing the manner in which the adsorbent unit of FIG. 9 fits in the upper portion of a refrigerant receiver;

FIG. 13 is a fragmentary cross sectional view taken substantially along line 13—13 of FIG. 12; and FIG. 14 is an enlarged fragmentary cross sectional view taken on line 14—14 of FIG. 13 showing the connection between the upper open end of a refrigerant conduit and the harness mounted bracket which mounts the adsorbent unit onto the refrigerant conduit.

DESCRIPTION OF THE PREFERRED EMBODIMENTS

Figure 1:
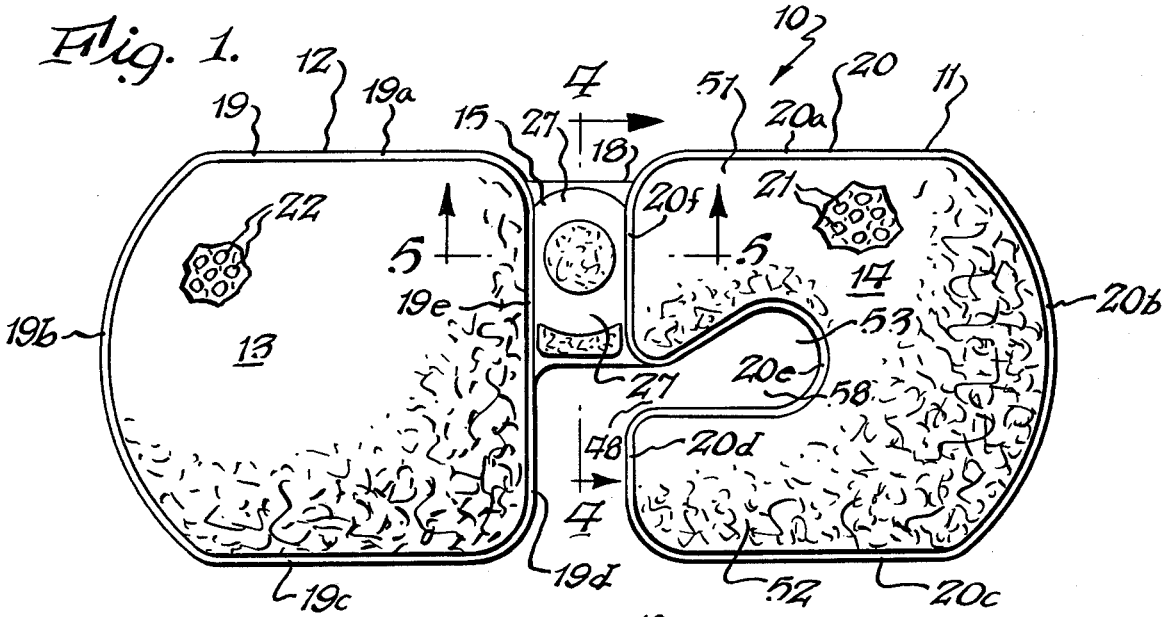
FIG. 1 is a top plan view, partially broken away, of the improved adsorbent unit of the present invention.
Figure 2:
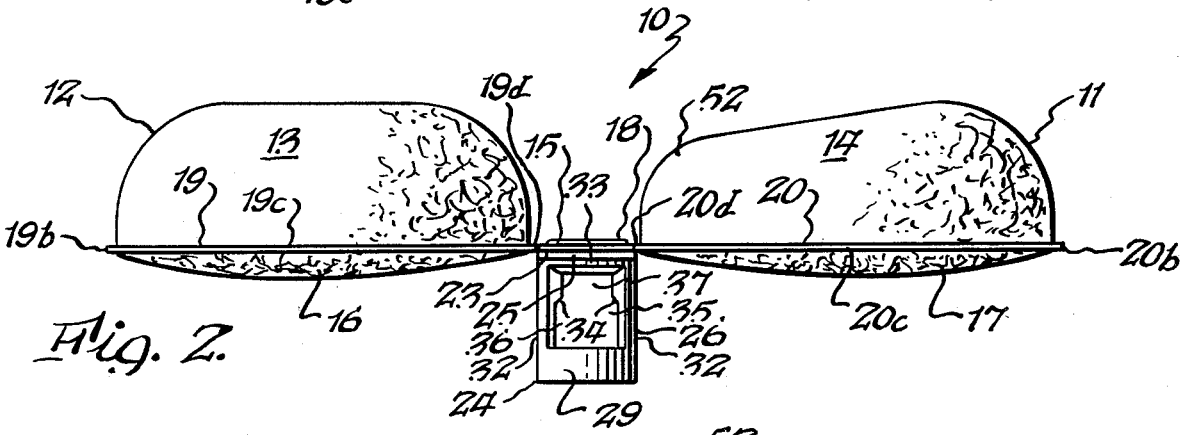
FIG. 2 is a side elevational view of the adsorbent unit of FIG. 1.
Figure 3:
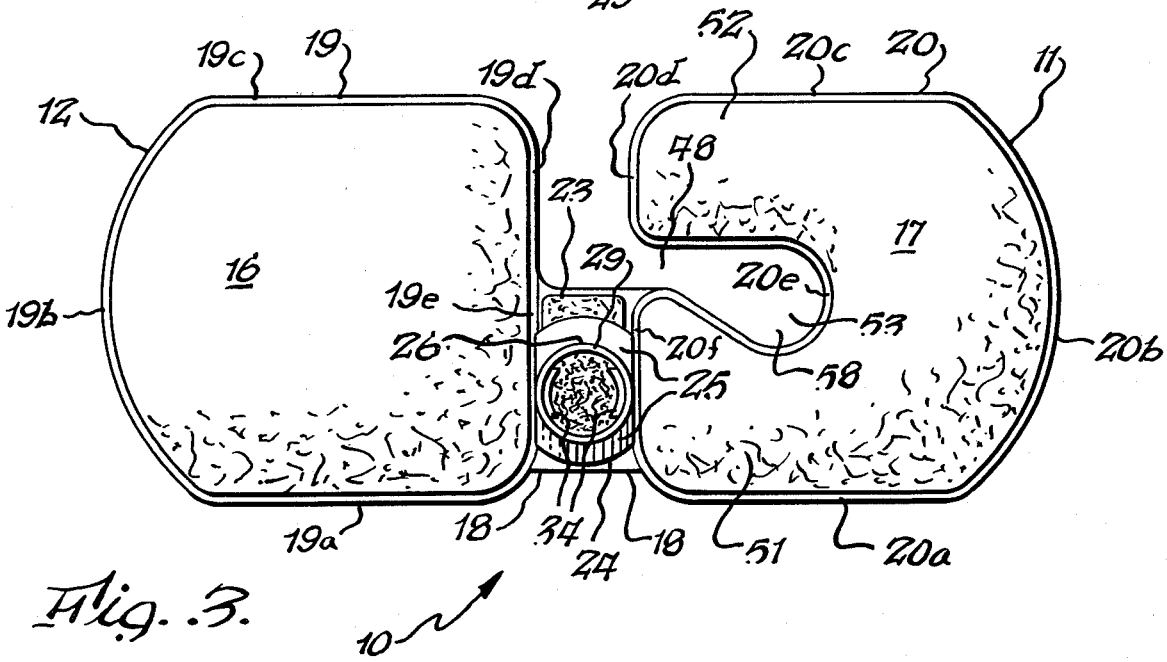
FIG. 3 is a bottom plan view of the adsorbent unit of FIG. 1.

One embodiment of the improved adsorbent unit 10 is shown in FIGS. 1-8. Adsorbent unit 10 includes a spaced adsorbent containers 11 and 12 which are connected to each other by harness 18. Container 12 includes a preformed concave pocket wall member 13, and container 11 includes a preformed U-shaped concave wall member 14. Concave members 13 and 14 are formed of a single piece of material and are connected to each other by harness portion 15 which is integral with wall members 13 and 14. Planar wall members 16 and 17 of suitable outline are secured to the edges of wall members 13 and 14 by fused seams 19 and 20, respectively, which extend completely around the peripheries of containers 11 and 12. Wall members 16 and 17 are connected by an integral harness portion 23. Fused seam 19 is endless and includes seam portions 19*a*, 19*b*, 19*c*, 19*d* and 19*e*. Seam 20 is endless and consists of seam portions 20*a*, 20*b*, 20*c*, 20*d*, 20*e* and 20*f*. Seam portions 19*e* and 20*f* fuse harness portions 15 and 23 to each other in addition to their functions of closing fusing the walls of containers 11 and 12.

Suitable adsorbent 21 and 22 is confined within containers 11 and 12. This adsorbent may be of any desirable composition and may selectively include, without limitation, adsorbents, such as silica gel, metal alumino silicate, alumina, calcium sulfate, activated charcoal, molecular sieve, or any other desired compound in bead, pellet or granular form.

Wall members 13, 14, 16 and 17 are preferably fabricated from porous thermoplastic felted fibrous fabric material, such as polypropylene, through which refrigerant may pass to come in contact with the adsorbent within containers 11 and 12. Since this material will melt when heated, the seams 19 and 20 can be formed by applying suitable heat and pressure to the areas where the seams are located. The fused seams 19 and 20 provide an extremely strong bond because the material at the seams is fused to a homogeneous mass. It will be appreciated, however, that containers 11 and 12 may be fabricated of any other suitable material, and if this material is not heat-fusible, it may be sewn to provide seams analogous to seams 19 and 20, or the seams may be formed by adhesive attachment, or in any other suitable manner. By way of example, walls 13, 14, 16 and 17 may be made of felted polypropylene, which is between about 0.065 and 0.097 inches thick and weighs about 9 ounces per square yard.

A mounting bracket 24 in the shape of a tubular member is secured to harness 18. Bracket 24 includes planar flanges 25 formed integrally with tubular portion 26. Bracket 24 is formed of polypropylene and flanges 25 are heat-sealed to harness 18 by suitable heat and pressure so as to form heat fused portions 27 on harness 18. The tubular portion 26 includes a ring 29 at its lower end which telescopically receives the upper open end 30 of refrigerant conduit 31. Diametrically opposed side members 32 are integral with and extend upwardly from ring 29 and merge into integral ring 33. Shoulders 34 are formed on side portions 32 and serve as a stop to limit the amount which ring 29 can move onto refrigerant conduit 31. The portion of bracket 24 between sides 32 comprises openings 35 which includes the lower openings 36 below shoulders 34 and the upper openings 37 above shoulders 34. It is through openings 37, when bracket 24 is mounted on conduit 31, that refrigerant enters the open end of conduit 31.

Figures 4, 5, 6, 7, 8:
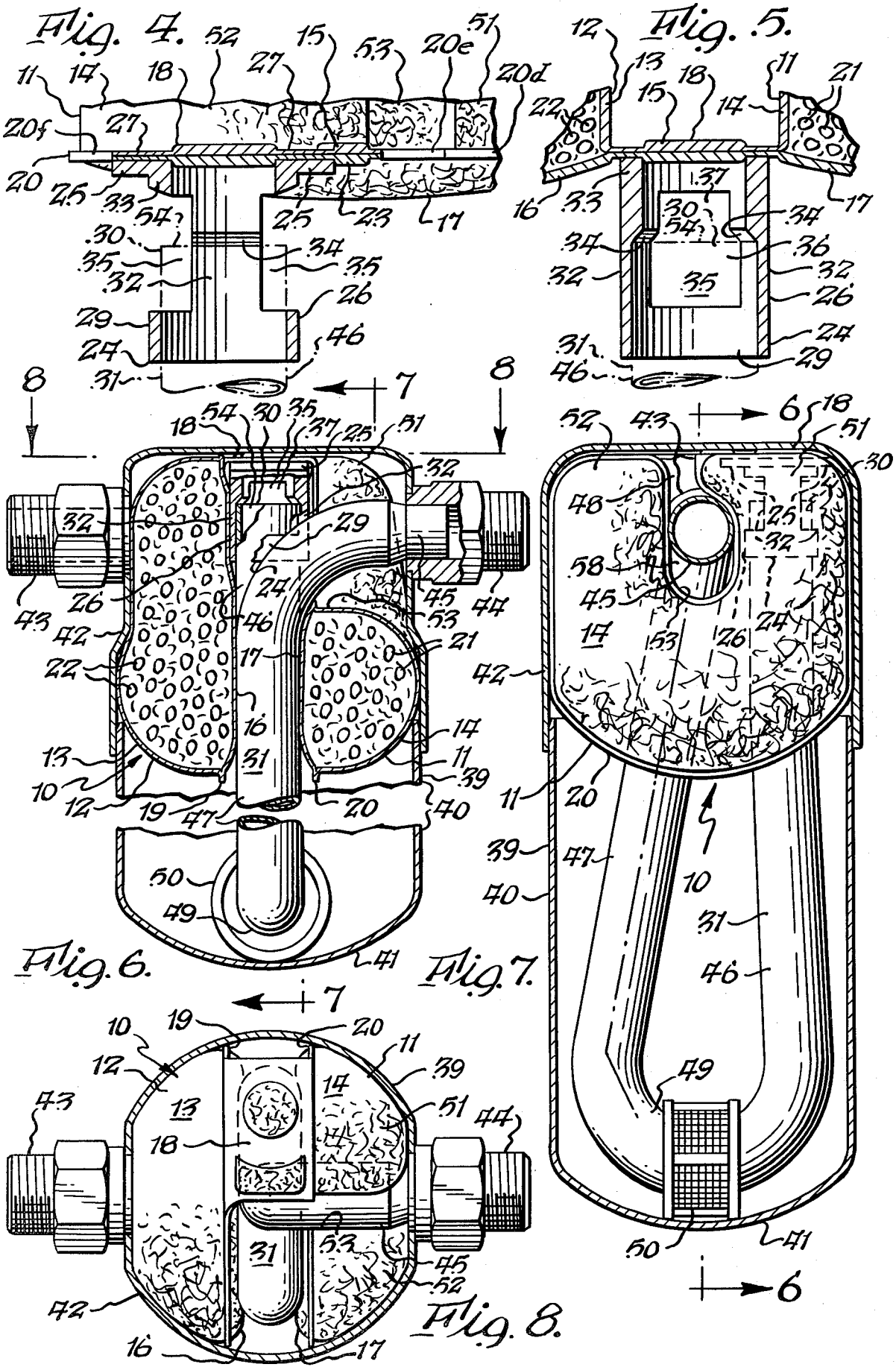
FIG. 4 is a fragmentary cross sectional view taken substantially along line 4—4 of FIG. 1.
FIG. 5 is a fragmentary cross sectional view taken substantially along line 5—5 of FIG. 1.
FIG. 6 is a fragmentary view, partially in cross section, taken substantially along line 6—6 of FIG. 7 and showing the improved adsorbent unit mounted on the upper portion of a refrigerant conduit in a refrigerant receiver.
FIG. 7 is a view, partially in cross section, taken substantially along line 7—7 of FIG. 6.
FIG. 8 is a cross sectional view taken substantially along line 8—8 of FIG. 6.

Adsorbent unit 10 is shown mounted in receiver 39 in FIGS. 6–8. Receiver 39 includes a lower generally cylindrical container 40 having an integral dished bottom 41. An upper portion or top 42 of generally cylindrical cross section, except as shown, telescopically receives the upper portion of cylindrical portion 40 and is suitably hermetically secured thereto, as by welding. Cover 42 includes a refrigerant inlet conduit 43 which conducts refrigerant into receiver 39 from the evaporator of the refrigeration system. An outlet conduit 44 is connected to the upper end portion 45 of refrigerant conduit 31. Refrigerant conduit 31 includes a first leg portion 46 which is open at its upper end 30 and a second leg portion 47 which has the upper end portion 45 in communication with outlet conduit 44. The lower portions of legs 46 and 47 are connected by an U-shaped portion 49 which has a small bleed hole in its lowermost portion, as is conventional. An annular screen member 50 surrounds lower portion 49, as is also conventional.

As can be seen from FIGS. 6–8, ring 29 telescopically receives upper portion 30 of refrigerant conduit leg 46. Since the fabric which forms the containers 11 and 12 and harness 18 is flexible, unit 10 can be formed so that containers 11 and 12 will lie on opposite sides of refrigerant conduit 31 as shown. Container 11 is U-shaped and has leg portions 51 and 52 which lie on opposite sides of recessed opening 53 so that portions 51 and 52 can lie on opposite sides of upper portion 45 of conduit 47 to fill upper portion 42 of the receiver with as much adsorbent as possible, to thereby provide the greatest adsorbing action. Recessed opening 53 includes a wider inner portion 58 and a narrower entry portion 48 which functions, as shown in FIGS. 7 and 13, to aid in mounting the adsorbent unit in position relative to the upper portions of conduit 31. Furthermore, as can be seen from FIGS. 6 and 7, adsorbent container 12 is in the path of refrigerant entering receiver 39 from conduit 43, and it will thus serve two functions. The first function is to act as a baffle so as to prevent refrigerant from conduit 43 entering directly into the open end 54 at the upper portion 30 of conduit leg 46. The second function is to cause the major portion of refrigerant to pass through container 12 so that good adsorption of foreign matter is virtually assured. The liquid portions of the refrigerant will drop to the bottom of the receiver and it will only be the gaseous or vapor portions which can enter the open end 54 of conduit leg 46. In addition, most portions of refrigerant in its vapor form will have to pass through containers 11 and 12 in order to reach open end 54, and thus impurities will further be adsorbed.

In FIGS. 9–14 a modified embodiment of the present invention is disclosed. The adsorbent unit 10' is substantially identical in all respects to unit 10 of FIGS. 1–8 except for the bracket which mounts the adsorbent unit on the open end of refrigerant conduit leg 46. Accordingly, the numerals in FIGS. 9–14 which are the same as those in FIGS. 1–8 will denote identical structure, thereby obviating the need for a redundant description. Bracket 55 includes a cylindrical portion 56 terminating at a flange 57. Bracket 55 is fabricated from polypropylene and is fused to harness 18 at 59 (FIG. 9). As can be seen from FIG. 14, open upper portion 30 of refrigerant conduit leg 46 is telescopically received within cylindrical bracket portion 56, and conduit portion 30 abuts portion 23 of harness 18. Thus, there are no openings, such as 37 of FIGS. 4 and 5, through which refrigerant can enter the open end of conduit 46. Therefore, the laminated portions 15 and 23 of harness 18 will act as a diffusion screen, or a dispersion screen, or an atomizer, to break up any liquid passing therethrough to enter refrigerant conduit leg 46 to thereby assure that it is only gaseous refrigerant which enters this leg, and thus slugging will be prevented. Except for the foregoing differences (1) in the construction of bracket 55 and (2) the manner in which adsorbent unit 10' is mounted on the refrigerant conduit 31, the adsorbent unit 10' is identical in all respects to the adsorbent unit 10 described in detail relative to FIGS. 1–8.

The construction of each container or bag 11 and 12 may incorporate the features of the bag shown and described in U.S. Pat. No. 4,272,264, issued June 9, 1981. The fibers on walls 13 and 14 may be tied down to prevent shedding or linting and all of the fused seams described above may contain completely melted fibers so that there is no linting from these seams either. All of the foregoing features are fully described in U.S. Pat. No. 4,272,264, which is incorporated herein by reference. Each container or bag 11 and 12 may also incorporate the features of the bags shown and described in U.S. Pat. No. 4,116,649, issued Sept. 26, 1978, except for the flap shown in this patent. This patent is also incorporated herein by reference. Each container may also incorporate the features of the bag shown and described in copending application Ser. Nos. 229,678, filed Jan. 29, 1981, and 172,266, filed July 20, 1980, which are also incorporated herein by reference.

While preferred embodiments of the present invention have been disclosed, it will be appreciated that the present invention is not limited thereto, but may be otherwise embodied within the scope of the following claims.

What is claimed is:

1. An adsorbent unit comprising a pair of containers having porous walls, adsorbent in said containers, harness means coupling said containers to each other, and mounting means for mounting said adsorbent unit on a refrigerant conduit in the upper portion of a refrigerant receiver.

2. An adsorbent unit as set forth in claim 1 wherein one of said containers is formed in the shape of an U with an opening between two leg portions for receiving a second upper portion of said refrigerant conduit.

3. An adsorbent unit as set forth in claim 1 wherein said mounting means comprises a bracket on said harness means.

4. An adsorbent unit as set forth in claim 3 wherein said porous walls are fabricated from fabric and wherein said harness means comprises an extension of said porous walls.

5. An adsorbent unit as set forth in claim 4 wherein said bracket comprises tubular means for mounting in telescopic relationship on said upper portion of said refrigerant conduit.

6. An adsorbent unit as set forth in claim 5 wherein said fabric is plastic, and wherein said tubular means is plastic, and wherein said tubular means is fused to said harness means.

7. An adsorbent unit comprising a container having a porous wall, adsorbent in said container, a harness including a planar member extending outwardly beyond said container, and a mounting bracket on said planar member for mounting said harness on the upper portion of a refrigerant conduit having an open end at the top of a refrigerant receiver, said mounting bracket comprising a tubular member having a longitudinal axis which extends transversely to said planar member for mounting in telescopic relationship on said upper portion of said refrigerant conduit.

8. An adsorbent unit as set forth in claim 7 wherein said planar member comprises an extension of said porous wall.

9. An adsorbent unit as set forth in claim 7 wherein said planar member is fabricated from plastic, and wherein said tubular member is fabricated from plastic and includes attachment means at one end thereof for attachment to said planar member, and wherein said attachment means are fused to said planar member.

10. An adsorbent unit as set forth in claim 1 wherein said tubular member has first and second ends, flange means on said tubular member at said first end, said second end being for mounting said tubular member in said telescopic relationship with said refrigerant conduit, and openings in said tubular member between said first and second ends for permitting passage of refrigerant to said refrigerant conduit.

11. An adsorbent unit as set forth in claim 7 wherein said tubular member includes first and second ends, and wherein said planar member is porous, means securing said first end of said tubular member to said porous planar member with said porous material lying across said first end, said second end being for mounting said tubular member in said telescopic relationship with said porous fabric in contiguous relationship to said open end of said upper portion of said refrigerant conduit so that refrigerant must pass through said porous material to enter said open end of said refrigerant conduit.

12. An adsorbent unit comprising first and second adsorbent containers having porous walls, harness means coupling said containers, bracket means on said harness means for mounting said containers on a member, said first container having a full pocket shape, and said second container being U-shaped with a pair of legs on the opposite sides of an opening therebetween.

13. An adsorbent unit as set forth in claim 12 wherein said harness means extends between the upper portion of one of said legs and said first container.

14. An adsorbent unit as set forth in claim 13 wherein said harness means comprises an extension of said porous walls.

15. An adsorbent unit as set forth in claim 13 wherein said bracket means comprises a tubular member, and wherein said member comprises a tubular conduit; and wherein said tubular member is telescopically mounted on said tubular conduit.

16. An adsorbent unit for mounting in the top portion of a refrigerant receiver having an inlet and an outlet and a refrigerant conduit having a first upper portion with an open end in the top portion of said receiver and a second upper portion in the top portion of said receiver in communication with said outlet and an intermediate portion extending downwardly between said first and second upper portions, said adsorbent unit comprising first and second containers having porous walls, adsorbent in said containers, harness means coupling said first and second containers to each other, and mounting means for mounting said adsorbent unit relative to said upper portions of said refrigerant conduit.

17. An adsorbent unit as set forth in claim 16 wherein said mounting means includes a recessed opening in said first container for receiving said second upper portion of said refrigerant conduit.

18. An adsorbent unit as set forth in claim 17 wherein said first container is in the shape of an U having a pair of legs, and wherein said recessed opening comprises an open space between said pair of legs.

19. An adsorbent unit as set forth in claim 17 wherein said second container is of a full pocket shape without a recessed opening therein.

20. An adsorbent unit as set forth in claim 16 wherein said second container is located in contiguous relationship to said inlet so as to lie in the path of refrigerant entering said receiver from said inlet.

21. An adsorbent unit as set forth in claim 16 wherein said mounting means comprises a bracket secured to said harness for mounting on said first upper portion of said refrigerant conduit.

22. An adsorbent unit as set forth in claim 21 wherein said bracket comprises a tubular member for mating in telescopic relationship with said first upper portion of said refrigerant conduit.

23. An adsorbent unit as set forth in claim 22 wherein said harness is fabric, and wherein said tubular member has first and second ends, and wherein said tubular member is secured to said fabric with said fabric lying across said first end, and wherein said open end of said first upper portion of said refrigerant conduit is telescoped with said second end of said tubular member.

24. An adsorbent unit as set forth in claim 21 wherein said harness is fabric and wherein said bracket mounts said harness across said open end of said first upper portion of said refrigerant conduit.

25. An adsorbent unit as set forth in claim 24 wherein said fabric of said harness is in contiguous relationship to said open end of said first upper portion of said refrigerant conduit so that refrigerant must pass through said harness to enter said open end of said refrigerant conduit.

26. An adsorbent unit as set forth in claim 24 wherein said bracket mounts said harness in spaced relationship to said open end of said first upper portion of said refrigerant conduit.

27. An adsorbent unit as set forth in claim 26 wherein said bracket comprises a tubular member having a first end secured to said harness and a second end for mounting in telescoping relationship with said first upper portion of said refrigerant conduit, and openings in said tubular member for permitting refrigerant to pass therethrough into said open end of said refrigerant conduit.

28. An adsorbent unit as set forth in claim 21 wherein said first container includes a recessed opening therein for receiving said second upper portion of said refrigerant conduit.

29. An adsorbent unit as set forth in claim 28 wherein said second container is located in contiguous relationship to said inlet of said refrigerant receiver so as to lie in the path of refrigerant entering said receiver from said inlet.

30. An adsorbent unit as set forth in claim 21 wherein said first and second containers include fabric walls, and wherein said harness comprises an extension of said fabric walls.

31. An adsorbent unit as set forth in claim 21 wherein said mounting means includes a recessed opening in said first container for receiving said second upper portion of said refrigerant conduit.

* * * * *

UNITED STATES PATENT AND TRADEMARK OFFICE

CERTIFICATE OF CORRECTION

PATENT NO. : 4,405,347

DATED : September 20, 1983

INVENTOR(S) : John S. Cullen et al

It is certified that error appears in the above-identified patent and that said Letters Patent are hereby corrected as shown below:

Column 5, line 52 (claim 10), change "1" to read --9--.

Signed and Sealed this

*Twenty-second* Day of *November 1983*

[SEAL]

*Attest:*

GERALD J. MOSSINGHOFF

*Attesting Officer*

*Commissioner of Patents and Trademarks*